US007300267B2

(12) United States Patent
Yildirim et al.

(10) Patent No.: US 7,300,267 B2
(45) Date of Patent: Nov. 27, 2007

(54) UNIT FOR DELIVERING FUEL TO AN INTERNAL COMBUSTION ENGINE

(75) Inventors: Fevzi Yildirim, Gerlingen (DE); Mehmet Gueluem, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/565,560

(22) PCT Filed: Jun. 17, 2004

(86) PCT No.: PCT/DE2004/001257

§ 371 (c)(1),
(2), (4) Date: Jan. 23, 2006

(87) PCT Pub. No.: WO2005/010368

PCT Pub. Date: Feb. 3, 2005

(65) Prior Publication Data

US 2007/0003422 A1 Jan. 4, 2007

(30) Foreign Application Priority Data

Jul. 22, 2003 (DE) ..... 103 33 190

(51) Int. Cl.

| | |
|---|---|
| ***F01C 21/10*** | (2006.01) |
| ***F03C 2/00*** | (2006.01) |
| ***F03C 4/00*** | (2006.01) |
| ***F04C 2/00*** | (2006.01) |

(52) U.S. Cl. ..... 418/150; 418/150; 418/148; 418/77; 418/206.5

(58) Field of Classification Search ..... 418/150, 418/148, 77, 206.5
See application file for complete search history.

(56) References Cited

U.S. PATENT DOCUMENTS

| | | | | |
|---|---|---|---|---|
| 4,480,973 | A | 11/1984 | Ishizuka | |
| 4,515,514 | A * | 5/1985 | Hayase et al. | 418/150 |
| 4,538,977 | A * | 9/1985 | Ruhl et al. | 418/150 |
| 4,737,090 | A | 4/1988 | Sakai et al. | |

FOREIGN PATENT DOCUMENTS

| | | | |
|---|---|---|---|
| DE | 28 35 457 | A1 | 3/1980 |
| DE | 3824882 | A1 * | 1/1990 |

* cited by examiner

*Primary Examiner*—Thomas Denion
*Assistant Examiner*—Douglas J. Duff
(74) *Attorney, Agent, or Firm*—Ronald E. Greigg

(57) ABSTRACT

A roller cell pump having a shaped sliding surface composed of elliptical portions results from two different equations. The function of the unit is improved because the equations are modified and include adaptable parameters, so that by adaptation of the parameters, the shaped sliding surface can be adapted in portions optimally to the requisite function in that particular region of the shaped sliding surface, for instance the function of generating an underpressure or an overpressure. The course of the radii of the elliptical portions corresponds, at least in portions, to one of two equations that differ from the prior art.

7 Claims, 3 Drawing Sheets

UNIT FOR DELIVERING FUEL TO AN INTERNAL COMBUSTION ENGINE

CROSS-REFERENCE TO RELATED APPLICATIONS

This application is a 35 USC 371 application of PCT/DE 2004/001257 filed on Jun. 17, 2004.

BACKGROUND OF THE INVENTION

1. Field of the Invention

The invention is directed to an improved unit for pumping fuel to an internal combustion engine.

2. Description of the Prior Art

German Patent DE 28 35 457 C2 discloses a roller cell pump in which a shaped sliding surface composed of elliptical portions results from two different equations. For various rotor diameters $R_2$, the shaped sliding surfaces that can be generated from the equations are all mathematically similar with regard to the function of the unit, such as hot gasoline pumping, efficiency, and wear behavior, and are not optimal, and are inconstant at the transitions between the ellipse halves, for eccentricities not equal to one.

SUMMARY AND ADVANTAGES OF THE INVENTION

The pump unit of the invention has the advantage over the prior art that an improvement in the function is attained in a simple way because a course of radii of the elliptical portions corresponds at least in portions to one of the equations disclosed. By varying the parameters contained in the equations, such as a parameter n and/or an eccentricity $s_1$, the shaped sliding surface can be adapted optimally in portions to the particular function required in that region of the shaped sliding surface, such as generating an underpressure in an intake region, generating an overpressure in a compression region, providing sealing in a sealing region, or establishing a constant volume in a reversal region.

Advantageous refinement of and improvement to the pumping unit are disclosed. It is especially advantageous if the radii of the elliptical portion are the same at the transitions, since in this way the shaped sliding surface has a constant course, and therefore major pressure fluctuations, which in the prior art often cause cavitation and oscillation of the roller bodies, do not occur. The wear of the roller bodies and the roller sliding surface are therefore markedly improved.

It is also advantageous if the slopes of the elliptical portions of the transitions are the same, since in this way the shaped sliding surface has a constant course, and lifting of the sealing bodies from the shaped sliding surface is avoided. As a result, pressure fluctuations in the pump work chambers are reduced markedly.

It is highly advantageous if the curvatures of the elliptical portions at the transitions are the same, since in this way the shaped sliding surface has a steady course, and major pressure fluctuations in the pump work chambers therefore do not occur.

In an advantageous embodiment, the parameter n in a reversal region is between greater than or equal to 1.9 and less than or equal to 2.1, since in this way the volume of the pump work chambers remains constant, so that no pressure peaks occur.

BRIEF DESCRIPTION OF THE DRAWINGS

Other features and advantages of the invention will become apparent from the description contained herein below, taken with the drawings, in which.

DESCRIPTION OF THE PREFERRED EMBODIMENTS

Figure 1:
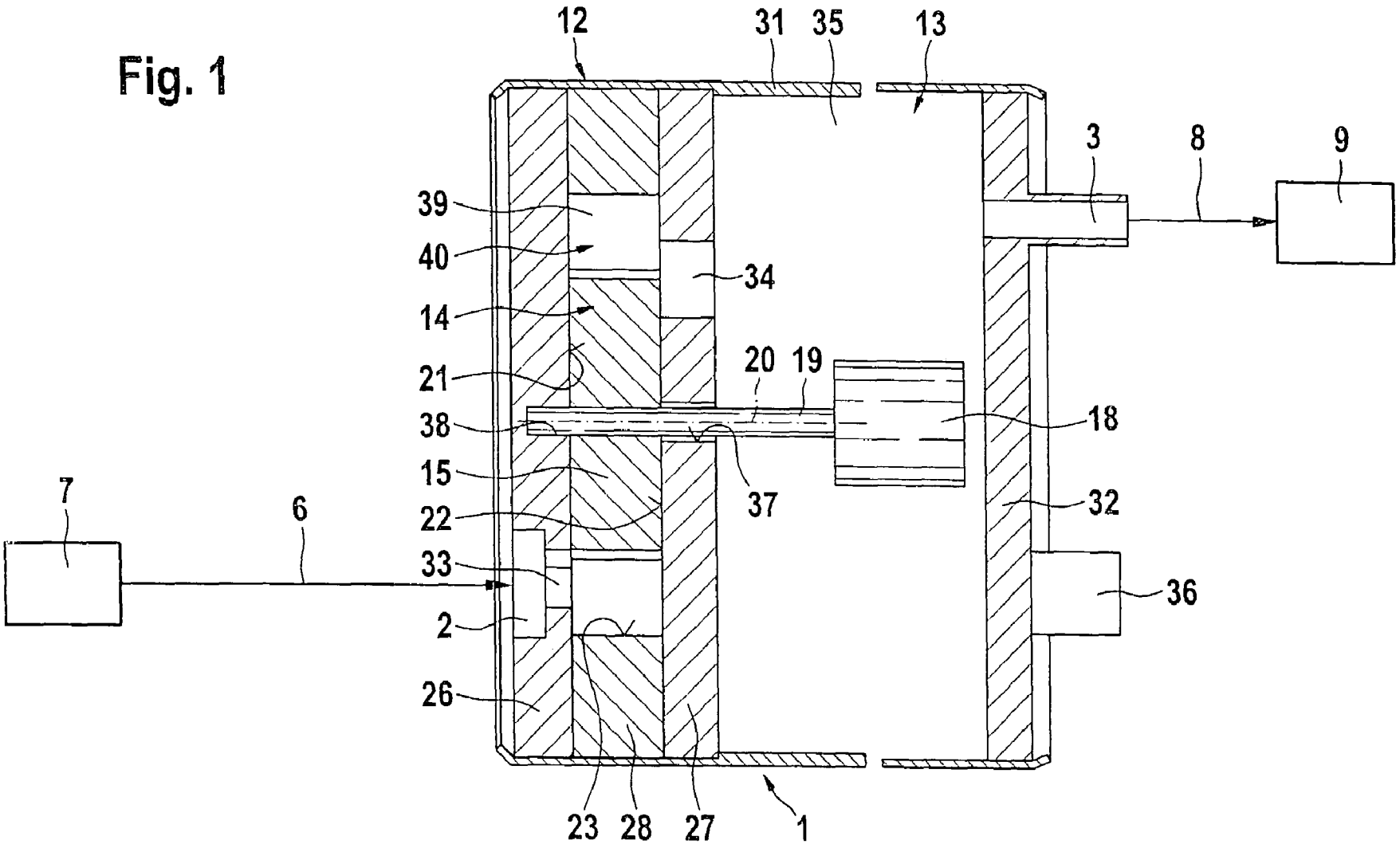
FIG. 1 shows a unit for pumping fuel.

FIG. 1 show a unit according to the invention for pumping fuel to an internal combustion engine, in which the unit has a cylindrical housing 1, for instance, with at least one inlet conduit 2 and one outlet conduit 3. The inlet conduit 2 of the unit communicates, for instance via a suction line 6, with a tank 7 in which fuel is stored. The oulet conduit 3 of the unit communicates with an internal combustion engine 9, for instance via a pressure line 8.

As an example, the unit is a so-called roller cell pump or a so-called vane cell pump. A roller cell pump is known from German Patent Disclosure DE 101 15 866 A1, for example, which is hereby expressly incorporated by reference.

The housing 1 of the unit has a pumping part 12 and a driving part 13. The pumping part 12 has a pump chamber 14, for instance embodied cylindrically. In the pump chamber 14, a rotor 15 is rotatably supported; the rotor 15 and the pump chamber 14 are located eccentrically relative to one another.

The rotor 15 is driven to rotate by an actuator 18, provided in the driving part 13 and for instance being an armature of an electric motor, via a drive shaft 19.

The pump chamber 14 is defined by two end walls diametrically opposite one another in the direction of a rotationally symmetrical axis 20 of the rotor 15, that is, by a first end wall 21 oriented toward the inlet conduit 2 and a second end wall 22 oriented toward the outlet conduit 3, and it is defined in the radial direction relative to the axis 20 by an annular wall 23.

The first end wall 21 is embodied on the inside, toward the rotor 15, of an intake cap 26, which for is instance disk-shaped, and the second end wall 22 is defined on the inside, toward the rotor 15, of a pressure cap 27, also for instance disk-shaped. The annular wall 23 is provided for instance on the inside, toward the rotor 15, of an annular intermediate ring or cap 28. The annular wall 23 may for instance be joined integrally in the form of a coating with the intermediate ring 28 or it may be embodied as a separate slide ring. A separate slide ring may for example be press-fitted, glued, welded, or screwed into the annular intermediate ring 28. The intermediate ring 28 is located for instance between the disk-shaped intake cap 26 and the disk-shaped pressure cap 27. However, the intermediate ring 28 may also be joined integrally with the intake cap 26 or the pressure cap 27. The intermediate ring 28 with the annular wall 23 is for instance located eccentrically to the rotor 15.

Both the intake cap 26 and the intermediate ring 28, like the pressure cap 27 and intermediate ring 28, are joined to one another respectively by force locking, for instance by means of a plurality of screws, or by form locking.

The housing 1 has a cylindrical portion 31, which has the intake cap 26 on the face end toward the pumping part 12 and a connection cap 32 on the face end toward the driving part 13. The intake cap 26 and the connection cap 32 close off the cylindrical portion 31 of the housing 1 tightly from the outer environment by engaging the inside of the cylindrical portion 31, for instance, and resting by their circumference, at least in portions, on the inside of the cylindrical portion 31.

The inlet conduit 2 of the housing 1 is located for instance on the intake cap 26 and communicates in the flow direction with a pump chamber inlet 33, which discharges into the pump chamber 14.

The outlet conduit 3 of the housing 1 is located for instance on the connection cap 32. The connection cap 32 for instance also has electrical connection elements 36 for providing electrical contact for the actuator 18 provided in the housing 1.

A pump chamber outlet 34, which causes the pump chamber 14 to communicate with a pressure chamber 35 of the housing 1, is located in the pressure cap 27 of the unit, for instance. The pump chamber outlet 34 may, however, also be provided on the intake cap 26. The pressure chamber 35 is defined radially by the cylindrical portion 31 and axially by the pressure cap 27 and the connection cap 32. The actuator 18, which drives the drive shaft 19 to rotate, is located for instance in the pressure chamber 35. The pressure cap 27 has a drive shaft conduit 37, through which the drive shaft 19 reaches into the pump chamber 14, so as to drive the rotor 15 to rotate. The drive shaft 19 is supported, for instance on the end remote from the actuator 18, in a bearing recess 38 in the intake cap 26. The pressure chamber 35 communicates with the engine 9 at least indirectly via the outlet conduit 3 of the housing 1 and the pressure line 8.

In a roller cell pump, the rotor 15 is for instance a cylindrical slotted disk. A plurality of sealing bodies 39 are provided on the rotor 15, distributed over the circumference, and in the case of a roller cell pump are embodied for instance as cylindrical rollers. The sealing bodies 39 are located for instance in radially extending guide grooves 40 of the rotor 15 and are pressed against the annular wall 23 by centrifugal force upon the rotation of the rotor 15, and slide or roll along the annular wail 23. The annular wall 23 in the process forms what is called a shaped sliding surface 24.

A region upstream of the pump chamber 14 is called the suction side of the unit, and a region downstream of the pump chamber 14 is called the compression side of the unit.

Figure 2:
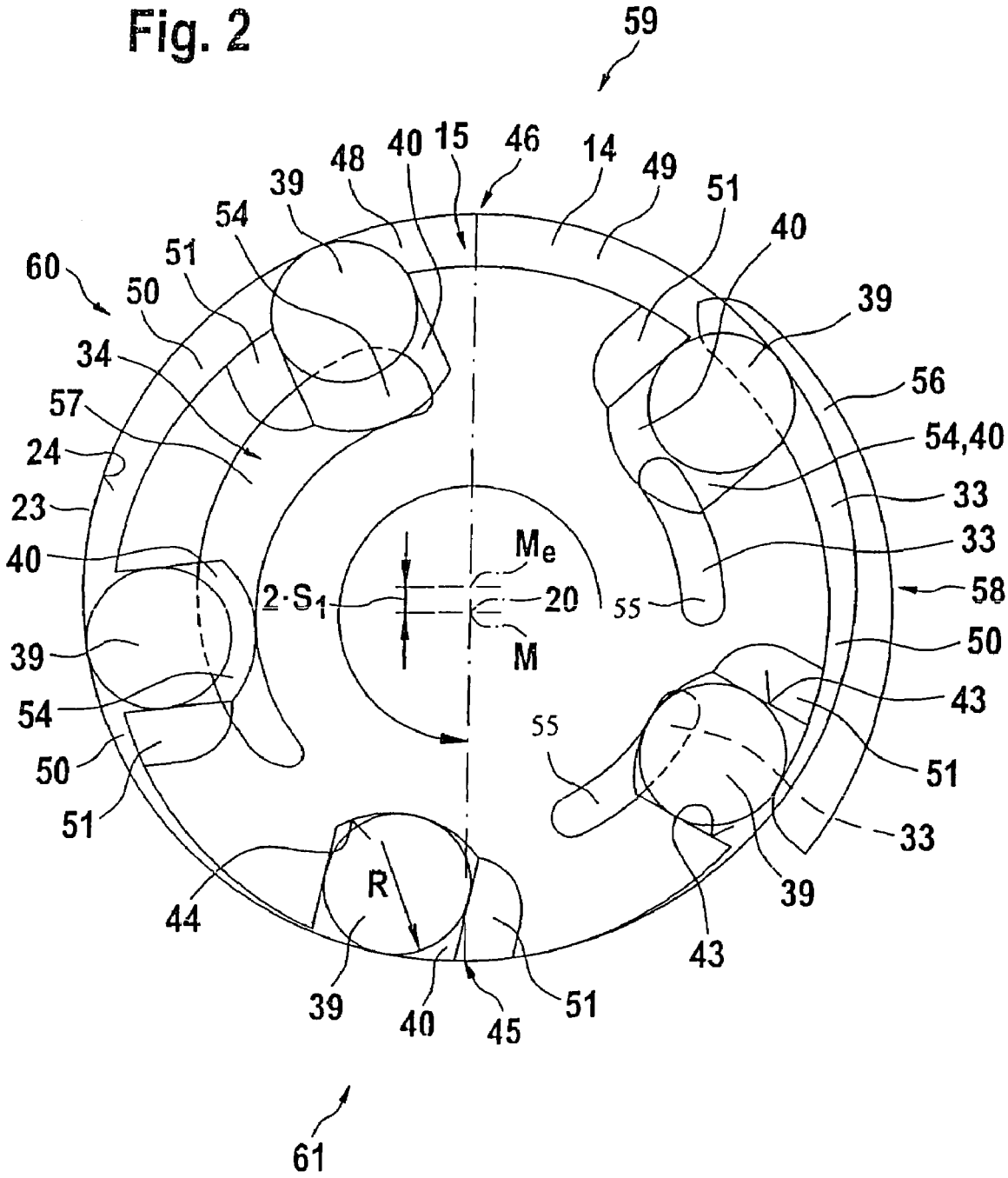
FIG. 2 shows a unit with a shaped sliding surface according to the invention.

FIG. 2 shows a unit that has a shaped sliding surface according to the invention.

In the unit of FIG. 2, those parts that remain the same or function the same as in the unit of FIG. 1 are identified by the same reference numerals.

A plurality of guide grooves 40 are located on the circumference of the rotor 15, for instance distributed uniformly over the circumference of the rotor 15. There is preferably an odd number of guide grooves 40. The guide grooves 40 reach through the rotor 15 in the axial direction from one face end of the rotor 15 to the other. The guide grooves 40 extend from the outer circumference radially inward with two side flanks 43, located for instance parallel to one another, and each ends in a respective curved groove bottom 44.

One sealing body 39 is provided in each guide groove 40. The sealing body 39 is supported movably in the direction of the side flanks 43 between the groove bottom 44 and the shaped sliding surface 24. The spacing of the side flanks 43 of a guide groove 40 is for instance only slightly greater than one dimension, such as the diameter, of the sealing body 39, since the sealing bodies 39 are in this way laterally guided in the radial direction. Upon the rotation of the rotor 15, the sealing bodies 39 are moved in the direction of the shaped sliding surface 24 and as a rule rest on the shaped sliding surface 24.

Because of the eccentric location of the rotor 15 in the pump chamber 14, there is a region of minimal spacing on the shaped sliding surface 24 between the rotor 15 and the shaped sliding surface 24, hereinafter called the narrow gap 45, and a region of maximal spacing on the shaped sliding surface 24 between the rotor 15 and the shaped sliding surface 24, hereinafter called the wide gap 46.

The eccentric location of the rotor 15 in the pump chamber 14 creates a crescent-shaped gap 48, between the shaped sliding surface 24 and the rotor 15, which is divided up by the sealing bodies 39 into a plurality of separate crescent-shaped gap chambers 49. The number of gap chambers 49 is equivalent to the number of sealing bodies 39.

Upon the rotation of the rotor 15, the sealing bodies 39 are pressed against the shaped sliding surface 24 and are each pressed against the respective trailing side flank 43, in terms of the direction of rotation, of the respective guide groove 40, so that the individual gap chambers 49 are sealed off from one another.

On the leading side flank 43, with respect to the direction of rotation of the rotor 15, of the respective guide groove 40, there is for instance at least one compensation pocket 51, which extends axially outward from one face end of the rotor 15 and extends axially from one face end of the rotor 15 radially inward.

The space bounded by the side flanks 43, the groove bottom 44, and the sealing body 39 of each guide groove 40 forms a groove chamber 54, which communicates, via the respective associated compensation pocket 51, with the adjacent gap chamber 49 that is the leading one relative to the direction of rotation of the rotor 15. The groove chamber 54, the compensation pocket 51, and the gap chamber 49 form a pump work chamber 50.

The pump chamber inlet 33 and/or the pump chamber outlet 34 are embodied for instance as a kidney-shaped groove. The pump chamber inlet 33 has three kidney-shaped inlet grooves, for instance, with for instance two inner inlet grooves 55 provided in the region of the groove chamber 54 radially outside the groove bottom 44 and one outer inlet groove 56, for instance, provided radially in the region of the annular wall 23.

The pump chamber inlet 33 is located for instance such that upon the rotation of the rotor 15, each pump work chamber 50 intermittently communicates fluidically with the pump chamber inlet 33 by overlapping, and fluid flows via the inlet conduit 2 and the pump chamber inlet 33 into the respective pump work chamber 50.

The pump chamber outlet 34 has for instance at least one outlet groove 57, which is located for instance in the region of the groove chamber 54 radially outside the groove bottom 44 and spaced apart circumferentially from the inlet grooves 55, 56. The pump chamber outlet 34 is located for instance such that upon the rotation of the rotor 15, each pump work chamber 50 intermittently communicates fluidically with the pump chamber outlet 34 by overlapping, and fluid from the respective pump work chamber 50 flows into the pump chamber outlet 34.

The shaped sliding surface 24 comprises an intake region 58, a reversal region 59, a compression region 60, and a sealing region 61. The intake region 58 is located in the region of the pump chamber inlet 33 between the narrow gap 45 and the wide gap 46; the reversal region 59 is located in the region of the wide gap 46 between the pump chamber inlet 33 and the pump chamber outlet 34; the compression region 60 is located in the region of the pump chamber outlet 34; and the compression region 61 is located in the region of the narrow gap 45.

In the intake region 58, the gap width of the gap 48 increases from the narrow gap 45, in the direction of rotation of the rotor 15, to the wide gap 46, so that the volume of the individual pump work chambers 50 increases in the direction of rotation of the rotor 15, and an underpressure occurs there. As soon as the pump chamber inlet 33 in the intake region 58, as a result of the rotation of the rotor 15, overlaps with one of the pump work chambers 50, the pump chamber inlet 33 is opened to the applicable pump work chamber 50, so that fluid continuously flows into the applicable pump work chamber 50. In the intake region 58, fluid is thus aspirated into the respective pump work chamber 50.

The filling of the particular pump work chamber 50 ends when the pump work chamber 50, because of further rotation of the rotor 15, no longer communicates with the pump chamber inlet 33. The pump work chamber 50 is then closed off from the environment and enters the reversal region 59.

In the reversal region 59, the pump work chamber 50 is closed and in this way seals off the pump chamber outlet 34 from the pump chamber inlet 33. In the reversal region 59, the shaped sliding surface 24 is designed such that the volume of the closed pump work chamber 50 remains at least approximately constant, so that unwanted increases in pressure do not occur in the closed pump work chamber 50. A reduction in the volume of the closed pump work chamber 50 would cause compression of the fluid and as a result a pressure increase in the applicable pump work chamber 50. Major increases in pressure in the closed pump work chamber 50 cause excessive oscillation of the sealing bodies 39, since the sealing bodies, because of the high pressure in the closed pump work chamber 50, are initially pressed radially inward, causing leakage into whichever pump work chamber 50 is leading at the time, and because of the pressure drop in the pump work chamber 50 caused by the leakage, they are pressed suddenly back against the shaped sliding surface 24. The impact of the sealing bodies 39 against the shaped sliding surface 24 would cause high wear at the shaped sliding surface 24 and/or at the sealing bodies 39. Because major pressure increases in the closed pump work chamber 50 are avoided, the occurrence of so-called cavitation, which because of the creation of vapor bubbles resulting from a failure to attain the vapor pressure of the fluid, and the abrupt collapse of the vapor bubbles on the shaped sliding surface 24 or on surfaces of the rotor 15 which can also cause wear to the shaped sliding surface 24 or the rotor 15, is at least reduced. Since cavitation in roller cell pumps occurs predominantly when the fuel is hot, the function of the unit of the invention is improved in the case of hot gasoline as well.

In the compression region 60, the respective pump work chamber 50 is emptied, because as a result of the reduction in volume of the respective pump work chamber 50, a pressure is built up, and the fluid is in this way pressed out of the pump work chamber 50 into the pump chamber outlet 34. This happens as soon as the pump chamber outlet 34 overlaps with the respective pump work chamber 50 upon the rotation of the rotor 15. The pump chamber outlet 34 is then opened toward the applicable pump work chamber 50.

The sealing region 61 seals off the compression region 60 from the intake region 58, so that if at all possible no leakage from the compression region 60 into the intake region 58 occurs. The radial gap width between the rotor 15 and the shaped sliding surface 24 in the sealing region 61 should be made as small as possible and the sealing region 61 should be made as large as possible, so that the fluid is emptied as completely as possible from the respective pump work chamber 50 in the direction of the pump chamber outlet 34, rather than reaching the intake region 58 again via the narrow gap 45 in the form of a leakage flow.

The shaped sliding surface 24 is composed of at least two and for instance four different elliptical portions; the radii, slopes and curvatures of the various elliptical portions at the transitions are the same.

The elliptical portions of the shaped sliding surface 24 have a common ellipse center point $M_e$, which is shifted by twice the value of the eccentricity $s_1$ from a center point M of the rotor 15 in the direction of an axis defined by the wide gap 46 and the narrow gap 45.

Figure 3:
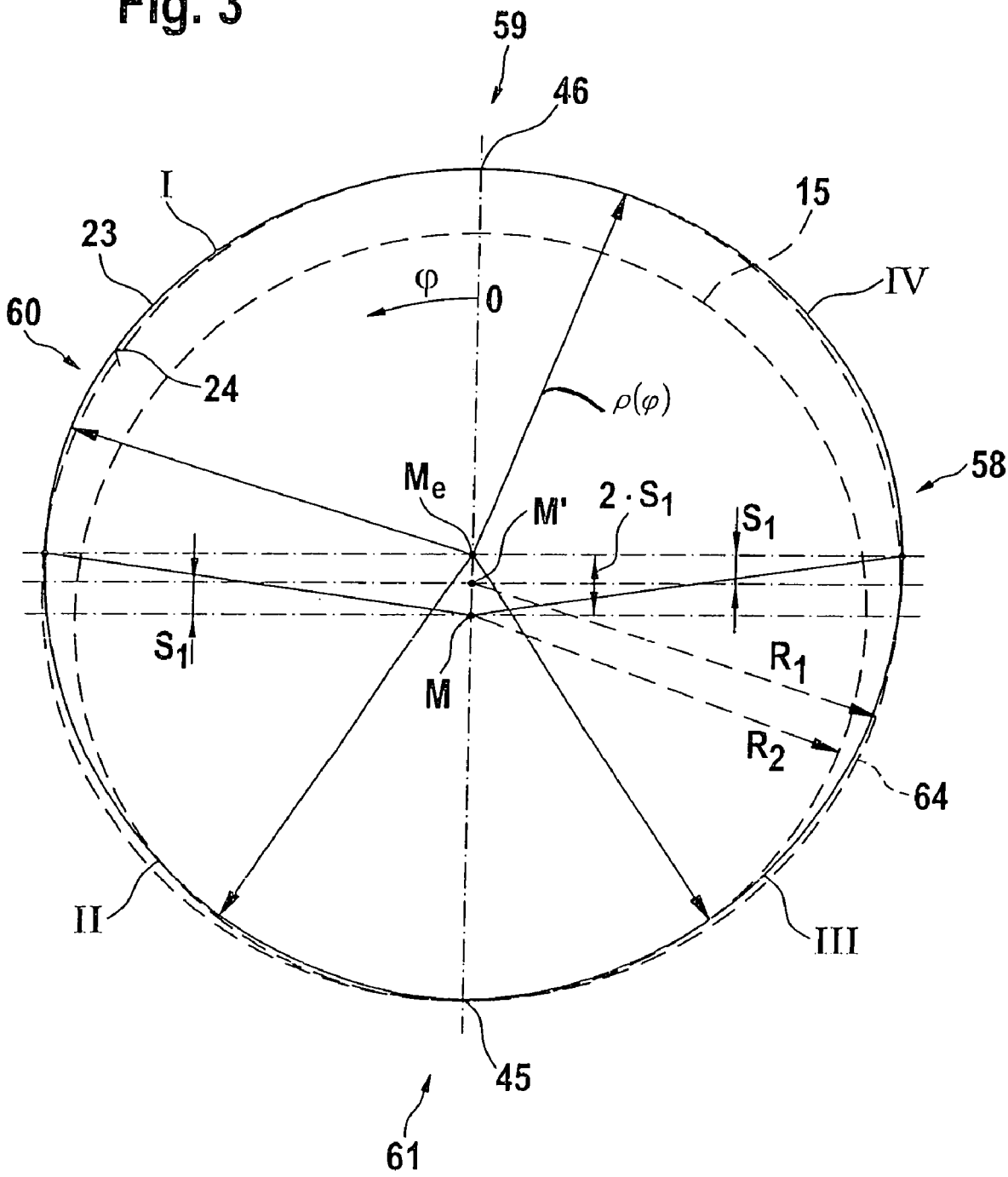
FIG. 3 shows a shaped sliding surface according to the invention.

FIG. 3 shows a shaped sliding surface according to the invention.

In the unit in FIG. 3, the elements that remain the same or function the same as in the unit of FIGS. 1 and 2 are identified by the same reference numerals.

The radius of the cylindrical rotor 15 is designated as $R_2$ in FIG. 3, and the radius of a circle 64, which extends through the wide gap 46 and the narrow gap 45 and which has a center point M', is designated $R_1$. The center point M' is shifted by the eccentricity $s_1$ from the center point M of the rotor 15 in the direction of an axis formed by the wide gap 46 and the narrow gap 45.

The course of the radius ρ, expressed in polar coordinates φ, of the elliptical portions of the shaped sliding surface 24 is calculated according to the invention in accordance with one of the two equations E1 and E2 given below, in which $R_2$ is the radius of the rotor 15; n is a variable power; and $s_1$ is the eccentricity:

$$\rho(\varphi) = \frac{R_2 * \sqrt{R_2 + 2s_1}}{\sqrt[n]{R_2^{n/2} * \left(\left|\cos\left(\varphi + \frac{\pi}{2}\right)\right|\right)^n + (R_2 + 2s_1)^{n/2} * \left(\left|\sin\left(\varphi + \frac{\pi}{2}\right)\right|\right)^n}} \tag{E1}$$

$$\rho(\varphi) = \frac{\sqrt{R_2} * (R_2 + 2s_1)}{\sqrt[n]{R_2^{n/2} * (|\cos(\varphi)|)^n + (R_2 + 2s_1)^{n/2} * (|\sin(\varphi)|)^n}} \tag{E2}$$

The origin of the angle φ is located on the axis formed by the wide gap 46 and the narrow gap 45, on the side toward the wide gap 46, and the angle φ extends counterclockwise.

According to the invention, by varying the parameters n and $s_1$ in the equations E1 and E2, the shaped sliding surface 24 for each elliptical portion can be optimized separately from one another with regard to the requisite function in that particular region of the shaped sliding surface 24, such as generating an underpressure in the intake region 58, avoiding increases of pressure and cavitation in the reversal region 59, generating an overpressure in the compression region 60, and the sealing function in the sealing region 61. The shaped sliding surfaces 24 that result upon variation of the parameters n and $s_1$ in the equations E1 and E2 are at least in part not mathematically similar.

By varying the parameter n, the radius ρ of an elliptical portion located in the sealing region 61 can be adapted in such a way that the shaped sliding surface 24, over a larger angular range, extends very closely along with rotor 15, with only a slight radial gap between them. As a result, the sealing action of the sealing region 61 is very good, so that the efficiency of the unit is higher than in the prior art.

Moreover, the radius ρ of an elliptical portion located in the intake region 58 can be adapted, by varying the parameter n, in such a way that the change in volume of the pump work chamber 50 increases sharply in the direction of rotation, so that a high underpressure in the pump work chamber 50 and a large gap chamber 49 are created. In this way, the pump work chambers 50 are filled in a shorter time and more completely than in the prior art.

By varying the parameter n and the eccentricity $s_1$, the radius p of an elliptical portion located in the reversal region 59 can be adapted such that the volume of the closed pump work chamber 50 remains virtually constant over a defined angular range, so that corresponding pressure peaks are at least reduced. This angular range amounts for instance to 80°, for a parameter n of 2.1 and an eccentricity of 1. Because of the at least approximate volumetric constancy of the closed pump work chamber 50, an unnecessary radial acceleration of the sealing bodies 39 and cavitation are avoided. As a result, there is less mechanical stress on the shaped sliding surface 24, so that wear is reduced and the life of the shaped sliding surface 24 is lengthened. The parameter n is preferably in the range between greater than or equal to 1.9 and less than or equal to 2.1, since in that range the volume of the closed pump work chamber 50 remains at least approximately constant. However, the parameter n may also be less than 1.9 or greater than 2.1.

By varying the eccentricity $s_1$, the gap 48 in the pump chamber 14 and thus the volume of the pump work chambers 50 is also varied. If the eccentricity $s_1$ is varied such that the gap 48 increases in size, then the volumetric flow that is pumped by the unit at the same rpm of the rotor 15 increases. The eccentricity $s_1$ is less than or equal to a radius of the sealing bodies 39 and is preferably in the range between 0.9 and 1.4.

The shaped sliding surface 24 is divided up into quadrants I through IV, for instance. A first quadrant I begins in the wide gap 46 and is located in the angular range of ϕ of between 0 and 90°; a second quadrant II is in the angular range of ϕ of between 90 and 180°, as far as the narrow gap 45; a third quadrant III is in the angular range of ϕ of between 180 and 270°; and a fourth quadrant IV is in the angular range of ϕ of between 270 and 360°.

The shaped sliding surface 24 may comprise two ellipse halves; for instance, the first elliptical portion is located in the first quadrant I and in the fourth quadrant IV, and the second elliptical portion is located in the second quadrant II and in the third quadrant III. The course of the radius of the first elliptical portion, in this exemplary embodiment, is calculated for instance in accordance with equation E1, and the course of the radius of the second elliptical portion is calculated for instance in accordance with equation E2.

The shaped sliding surface 24 may, however, also have three elliptical portions, with the first elliptical portion extending for instance over two quadrants, and the second elliptical portion and the third elliptical portion each extending over one quadrant. In this exemplary embodiment, the course of the radius of the first elliptical portion and the third elliptical portion is calculated for instance in accordance with equation E1, and the course of the radius of the second elliptical portion is calculated for instance in accordance with equation E2.

The shaped sliding surface 24 may also have four elliptical portions, with each elliptical portion occupying one of the quadrants I, II, III, IV. In this exemplary embodiment, the course of the radius of the first elliptical portion and of the fourth elliptical portion is calculated for instance in accordance with equation E1, and the course of the radius of the second elliptical portion and of the third elliptical portion is calculated for instance in accordance with equation E2.

The elliptical portions of the shaped sliding surface 24 may extend over one or more complete quadrants I, II, III, IV, or over only a part of one or more of the quadrants I, II, III, IV. Each elliptical portion may be calculated with one of the two equations E1 and E2.

The foregoing relates to preferred exemplary embodiment of the invention, it being understood that other variants and embodiments thereof are possible within the spirit and scope of the invention, the latter being defined by the appended claims.

What is claimed is:

1. In a pump unit for pumping fuel to an internal combustion engine, having a rotor supported eccentrically in a pump chamber, a plurality of guide grooves disposed on the rotor circumference, and sealing bodies disposed in the grooves that are guided in the radial direction along a shaped sliding surface in the pump chamber, the shaped sliding surface having elliptical portions, the improvement wherein the course, expressed in polar coordinates (ϕ), of the radii (ρ) of the elliptical portions corresponds at least in portions to one of the two following equations, in which ($R_2$) is the radius of the rotor, n is a variable power, and ($s_1$) is the eccentricity:

$$\rho(\varphi) = \frac{R_2 * \sqrt{R_2 + 2s_1}}{\sqrt[n]{R_2^{n/2} * \left(\left|\cos\left(\varphi + \frac{\pi}{2}\right)\right|\right)^n + (R_2 + 2s_1)^{n/2} * \left(\left|\sin\left(\varphi + \frac{\pi}{2}\right)\right|\right)^n}}$$

$$\rho(\varphi) = \frac{\sqrt{R_2} * (R_2 + 2s_1)}{\sqrt[n]{R_2^{n/2} * (|\cos(\varphi)|)^n + (R_2 + 2s_1)^{n/2} * (|\sin(\varphi)|)^n}}$$

2. The unit according to claim 1, wherein the parameter n is in the range between greater than or equal to 1.9 and less than or equal to 2.1.

3. The unit according to claim 1, wherein the eccentricity ($s_1$) is less than or equal to a radius (R) of the sealing body.

4. The unit according to claim 1, wherein the radii (ρ) of the various elliptical portions are the same at the transitions.

5. The unit according to claim 1, wherein the slopes of the various elliptical portions are the same at the transitions.

6. The unit according to claim 1, wherein the curvatures of the various elliptical portions are the same at the transitions.

7. The unit according to claim 1, wherein the shaped sliding surface has from two to four elliptical portions.

* * * * *